US005182002A

United States Patent [19]

Yamamoto et al.

[11] Patent Number: 5,182,002

[45] Date of Patent: Jan. 26, 1993

[54] LINE FOR CONTINUOUSLY ANNEALING AND PICKLING STAINLESS STEEL STRIP

[75] Inventors: Tadashi Yamamoto, Takarazuka; Takao Seno, Minoh; Shuichiro Shiota, Yamatokoriyama, all of Japan

[73] Assignee: Chugai Ro Company, Limited, Osako, Japan

[21] Appl. No.: 854,005

[22] Filed: Mar. 19, 1992

[30] Foreign Application Priority Data

May 1, 1991 [JP] Japan ..... 3-100111

[51] Int. Cl.[5] ..... C25F 7/00

[52] U.S. Cl. ..... 204/210

[58] Field of Search ..... 204/210

[56] References Cited

FOREIGN PATENT DOCUMENTS 1-252781 10/1989 Japan .

*Primary Examiner*—T. M. Tufariello

*Attorney, Agent, or Firm*—Birch, Stewart, Kolasch & Birch

[57] ABSTRACT

A line for continuously annealing and pickling a stainless steel strip comprising: a drying/temperature adjusting zone, provided between a water cooling zone and a tank containing a neutral salt electrolytic solution, including hot air jetting means which controls the temperature and amount of hot air so as to dry the stainless steel strip after the stainless steel strip is cooled with water and uniformly heat the temperature of the material of the stainless steel strip.

2 Claims, 2 Drawing Sheets

LINE FOR CONTINUOUSLY ANNEALING AND PICKLING STAINLESS STEEL STRIP

BACKGROUND OF THE INVENTION

1. Field of the Invention

The present invention relates to a line for continuously annealing and pickling a stainless steel strip.

2. Description of the Related Arts

In recent years, the following method is carried out by a line for continuously annealing and pickling a stainless steel strip, a stainless steel strip (S) is annealed by a catenary type continuous annealing furnace (not shown); the stainless steel strip (S) is cooled by a spray type water cooling zone 1; the stainless steel strip (S) is dewatered by dewatering means 5 comprising a wiper roll unit 3 and an air nozzle unit 4 unit provided in the exit 2 of the water cooling zone 1; and then, the stainless steel strip (S) is electrolyzed in a tank 6 containing a neutral salt electrolytic solution to remove a scale formed on the surface of the stainless steel strip (S) while it is annealed.

In the neutral salt electrolytic processing, it is known as disclosed in Japanese Patent Laid-Open Publication No. 62-124232 that pickling effect is favorable with the rise of the temperature of the neutral salt electrolytic solution (W) even though current density is small.

When the temperature of the neutral salt electrolytic solution (W) is set to 60° to 100° C., the temperature of the stainless steel strip (S) is set to 60° to 100° C. at the exit of the water cooling zone 1 in the conventional equipment. As a result, the temperature of the stainless steel strip (S) in the longitudinal direction thereof is different (maximum: 50° C.) from that in the widthwise direction thereof. Thus, the stainless steel strip (S) has a low temperature region.

Accordingly, with the fall of the temperature of the neutral salt electrolytic solution (W), pickling effect degrades. Consequently, current density becomes high, i.e., power consumption becomes great. In addition, the stainless steel strip (S) has high and low temperature regions. As a result, the temperature of the neutral salt electrolytic solution which is in contact therewith is not uniform. As such, a uniform scale removal cannot be accomplished.

The dewatering means 5 is incapable of dewatering the stainless steel strip (S) from the surface thereof completely and the stainless steel strip (S) slips on a bridle roll 7. As a result, an abnormal wear occurs on the surface of the bridle roll 7 and the tension of the stainless steel strip (S) fluctuates, thus resulting in various troubles.

SUMMARY OF THE INVENTION

It is therefore an object of the present invention to provide a line, for continuously annealing and pickling a stainless steel strip, provided with a tank containing a neutral salt electrolytic solution, so as to save energy by reducing the temperature fluctuation of a neutral salt electrolytic solution, remove a scale formed on the surface of the stainless steel strip efficiently, and prevent the stainless steel strip from slipping on a bridle roll and the bridle roll from being damaged.

In accomplishing these and other object, there is provided a line for continuously annealing and pickling a stainless steel strip comprising: a drying/temperature adjusting zone, provided between a water cooling zone and a tank containing a neutral salt electrolytic solution, including hot air jetting means which controls the temperature and amount of hot air so as to dry the stainless steel strip after the stainless steel strip is cooled with water and uniformly heat the temperature of the material of the stainless steel strip.

According to the above-described construction, a stainless steel strip discharged from the water cooling zone of the line is uniformly heated up to a temperature by hot air in the longitudinal and widthwise directions thereof in the drying/temperature adjusting zone and in addition, water existing on the surface of stainless steel strip is removed and immersed in the tank containing the neutral salt electrolytic solution.

Accordingly, the temperature of the neutral salt electrolytic solution does not fluctuate, power consumption is small, and a scale formed on the stainless steel strip can be removed uniformly.

Further, since the stainless steel strip is dry, it does not slip on the bridle roll, the bridle roll is not worn, and the tension of the stainless steel strip does not fluctuate.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
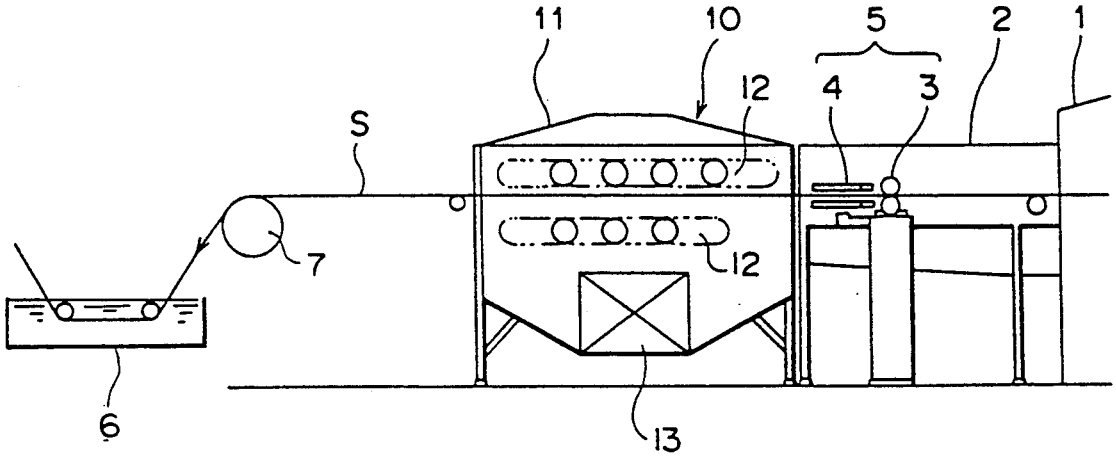
FIG. 1 is a front view showing a principal portion of a line for continuously annealing and pickling a stainless steel strip according to the present invention.

Before the description of the present invention proceeds, it is to be noted that like parts are designated by like reference numerals throughout the accompanying drawings.

Figure 2:
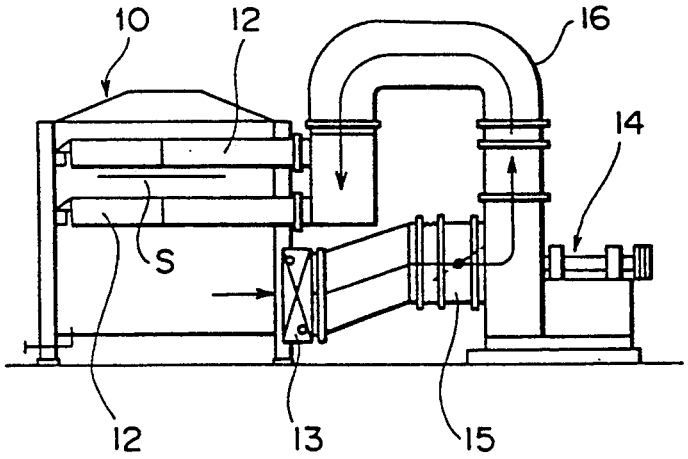
FIG. 2 is a sectional view taken along a line II—II of FIG. 1.
Figure 3:
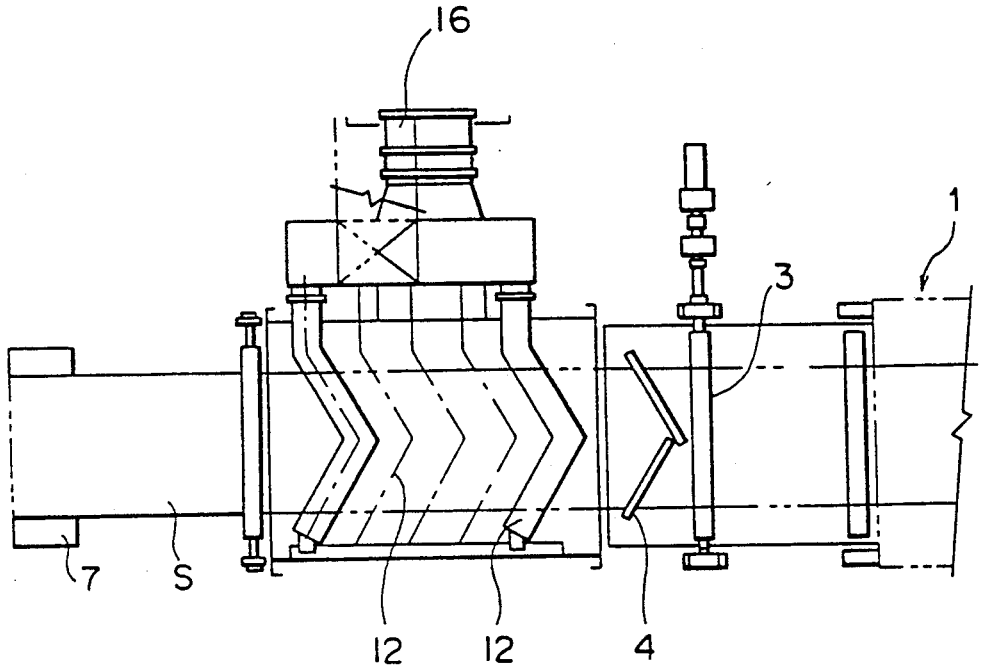
FIG. 3 is a plan view showing the equipment for continuously annealing and pickling a stainless steel strip shown in FIG. 1.
Figure 4:
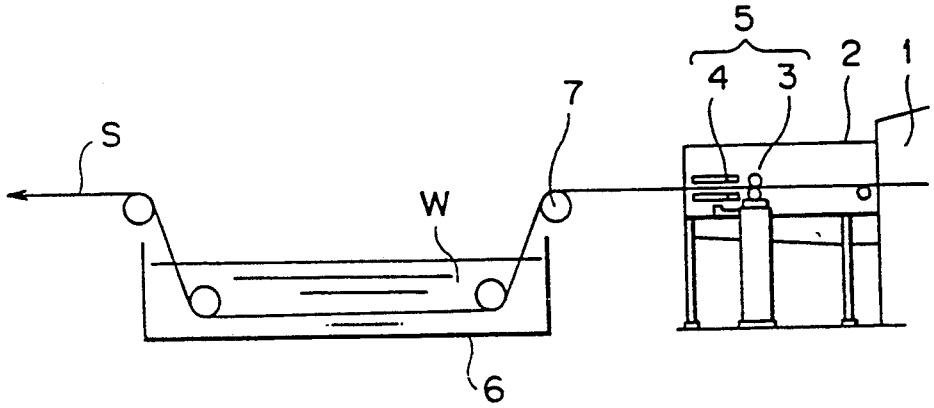
FIG. 4 is a schematic view showing a conventional line continuously annealing a stainless steel strip and removing an oxide formed on the surface thereof.

An embodiment of the present invention will be described below with reference to FIGS. 1, 2, and 3.

As apparent from FIG. 1, in the line for continuously annealing and pickling a stainless steel strip (S), a drying/temperature adjusting zone 10 is provided between the spray type water cooling zone 1 and the tank 6 containing a neutral salt electrolytic solution.

In the drying/temperature adjusting zone 10, there are a plurality of nozzle headers 12 arranged opposite each other. The strip (S) passes between these sets of nozzle headers. Hot air jets out from the nozzles (not shown) provided on the facing surfaces of the nozzle headers 12. The atmosphere in the casing 11 is heated up to a predetermined temperature during passing through a heater 13. Then, a circulating fan 14 supplies the hot air to the nozzle headers 12 through a hot air supply duct 16. The supply valume of the hot air is controlled by a flow rate adjusting valve 15.

The dewatering means 5 dewaters the stainless steel strip (S) cooled by the water cooling zone 1. The hot air jetted out from the nozzles of the nozzle headers 12 dries water existing on the stainless steel strip (S). The stainless steel strip (S) is kept at a predetermined temperature of 80° C.±5° C. That is, the temperature of the stainless steel strip (S) becomes equal to that of the neutral salt electrolytic solution. The temperature of the stainless steel strip (S) is adjusted by adjusting the temperature of the heater 13 and/or the open degree of the flow rate adjusting valve 15 according to the material and thickness of the stainless steel strip (S).

The stainless steel strip (S) having a uniform temperature in its entirety is immersed in the neutral salt electrolytic solution of the tank 6 to remove a scale formed thereon.

The dewatering means 5 is provided in the leading end portion of the water cooling zone 1 of the line in this embodiment, however, the dewatering means 5 is not necessarily provided.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A line for continuously annealing and pickling a stainless steel strip comprising: a drying/temperature adjusting zone, provided between a water cooling zone and a tank containing a neutral salt electrolytic solution, including hot air jetting means which controls the temperature and amount of hot air so as to dry said stainless steel strip after said stainless steel strip is cooled with water and uniformly heat the temperature of the material of said stainless steel strip.

2. The line for continuously annealing and pickling a stainless steel as defined in claim 1, wherein said hot air jetting means includes nozzle headers, a heater, a circulating fan, and a flow rate adjusting valve.

* * * * *

UNITED STATES PATENT AND TRADEMARK OFFICE

CERTIFICATE OF CORRECTION

PATENT NO. : 5,182,002

DATED : January 26, 1993

INVENTOR(S) : Tadashi Yamamoto, et al.

It is certified that error appears in the above-indentified patent and that said Letters Patent is hereby corrected as shown below:

On the title page, item (73) Assignee:

change "Osako" to --Osaka--.

Signed and Sealed this

Ninth Day of November, 1993

Bruce Lehman

*Attest:*

BRUCE LEHMAN

*Attesting Officer*

*Commissioner of Patents and Trademarks*